United States Patent [19]

Pauliukonis

[11] 4,178,768

[45] Dec. 18, 1979

[54] INTERNALLY PILOTED REVERSING VALVE FOR HEAT PUMP

[76] Inventor: Richard S. Pauliukonis, 6660 Greenbriar Dr., Cleveland, Ohio 44130

[21] Appl. No.: 872,231

[22] Filed: Jan. 25, 1978

[51] Int. Cl.[2] ..... F25B 13/00

[52] U.S. Cl. ..... 62/160; 62/324

[58] Field of Search ..... 62/324 A, 324 B, 324 C, 62/324 D, 324 E, 324 F, 324 R, 160; 137/625.27, 625.61, 625.64; 165/62

[56] References Cited

U.S. PATENT DOCUMENTS

| | | | |
|---|---|---|---|
| 2,534,031 | 12/1950 | Kollsman | 62/324 A |
| 2,976,701 | 3/1961 | Greenawalt | 62/160 |
| 2,983,286 | 5/1961 | Greenawalt et al. | 62/324 A |
| 3,032,312 | 5/1962 | Greenawalt | 62/160 |
| 3,081,790 | 3/1963 | Radford | 62/324 A |
| 3,293,880 | 12/1966 | Greenawalt | 62/324 A |
| 3,400,736 | 9/1968 | Bastle et al. | 62/324 A |
| 3,411,538 | 11/1968 | Gruner et al. | 62/324 A |
| 4,055,056 | 10/1977 | Perkins | 62/324 A |
| 4,112,974 | 9/1978 | Davis et al. | 62/324 R |

*Primary Examiner*—Lloyd L. King

[57] ABSTRACT

An internally piloted reversing refrigerant valve for selectively porting fluid from a compressor into an air-conditioning system doubling as heat pump through a five-ported valve of which ports one, two, three and four are employed with air-conditioning system when valve is in a first position, while when the position of valve is changed to a second reversed position, ports one, three, two and five are employed with heat pump system, said valve so constructed that the first and second ports allow fluid to be delivered to a refrigeration system for a return to compressor through ports three and four of a valve housing provided with a slidably movable piston assembly and a pair of operators including valve means incorporated therein so as to allow a complete fluid reversal and refrigerant delivery from compressor to heat pump through the first and third ports for a return to compressor through ports two and five facilitating means for a simple valve to serve two flow patterns through an easy valve shifting operation wherein fluid pressure of internal pilot means incorporated therein performs said position change using high pressure compressor refrigerant which subsequently is exhausted into the low pressure side of the system served by this valve.

8 Claims, 1 Drawing Figure

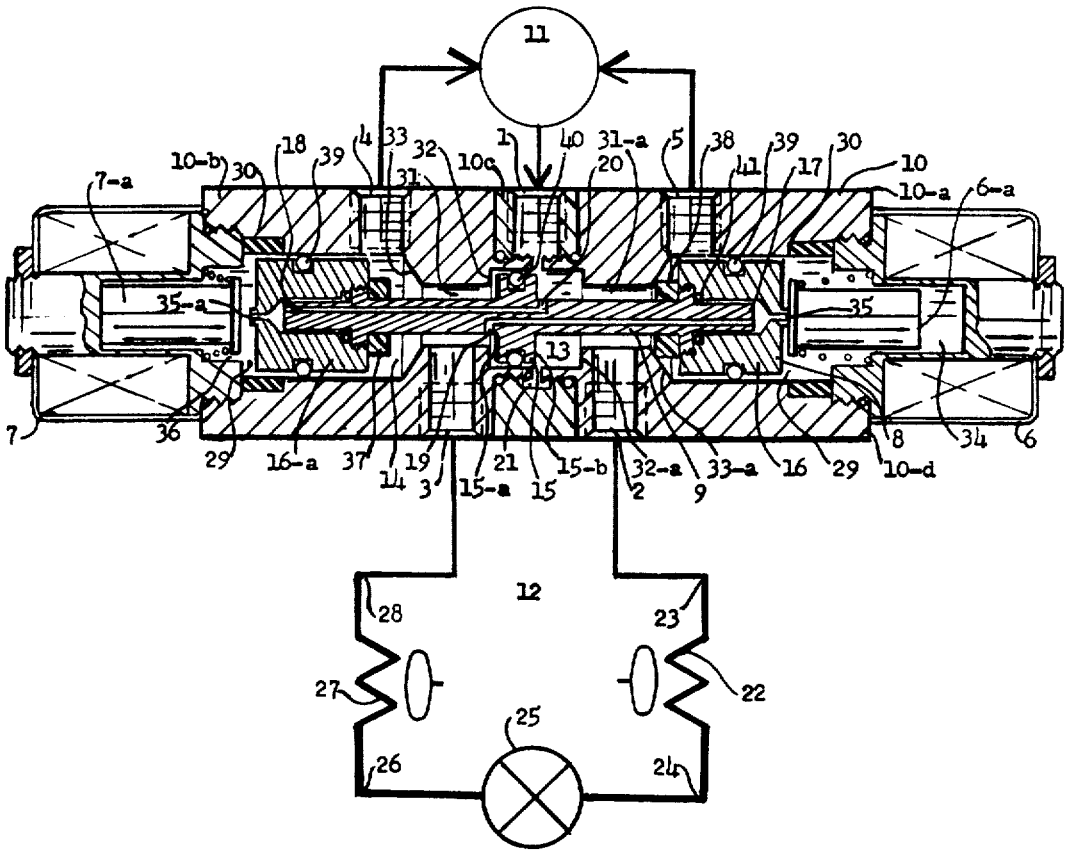
11
1
40
31-a
5
38
39
30
10
10-a
6-a
10-b
30
18
39
4
33
32
31
10c
20
41
17
7-a
35-a
35
13
7
36
29
16-a
37
14
19
3
21
15-a
15
15-b
2
32-a
9
33-a
16
29
10-d
8
34
6
12
28
23
27
22
25
26
24

INTERNALLY PILOTED REVERSING VALVE FOR HEAT PUMP

This invention relates to valves used with air-conditioning systems which can be converted to heat pumps easily, and more specifically to fluid reversing valves also called switching valves in refrigeration systems designated to serve both cooling and heating requirements with seasonal changes by the use of the same equipment.

Reversing valves in existance are not only complicated but also extremely costly since majority of them use conventional design approaches which lack on novelty. For example, most of conventional valves employ separate air systems for supply of pressurized air which is used as a pilot fluid for stem shifting during valve reversal operation, since there was no way of discharging high pressure refrigerant if used for piloting back into the system. Other conventional valves are employing heavy duty solenoid operators to overcome pressures to which valve components such as various valving means are exposed, compiling the problem and the cost of such valves.

Therefore, the main object of the present invention is to provide a valve which can reverse fluid flow therethrough by the use of fluid dynamics wherein the refrigerant under high pressure is piloted internally to the valve operating means for flow redirection, and discharged to the low pressure side of the system thereafter. Another object of this invention to provide a simple and less costly valve for fluid reversal in refrigeration system doubling as a heat pump system. A further object of this invention is to incorporate a small and inexpensive solenoid operator into the valve operating system thereof in an operable relationship so as to have a pilot piston perform valve shifting for flow reversal independent of pressures of the refrigerant in the system.

Other objects and advantages of this invention will become more fully apparent from the following description of the embodiment of the invention, taken together with the accompanying drawing.

IN THE DRAWING

Illustration of the valve in cross-section in a system identifies not only the basic components but also a flow pattern of a conventional air-conditioning system prior to fluid reversal to serve heat pump system.

As can be seen from the drawing, a two position internally piloted fluid reversal valve 10, adaptable to direct the flow of refrigerant from a compressor 11 into two opposite flow patterns, can be described best when illustrated in a system such as indicated diagrammatically at 12 representing a typical air-conditioning system valve 10 is to revert into a heat pump for heat extraction from the refrigerant first before it is returned to compressor 11.

Valve 10 shown has an elongated valve housing **10-*d* provided with a first port 1 connected to compressor 11, and communicating with a second port 2 which leads to a condenser 22 supplying refrigerant under pressure via fluid conduit 23 to flow via conduit 24 into an expander 25 for presssure and temperature reduction and subsequent return to compressor 11 via conduit 26 passing an evaporator 27 and another conduit 28 before entering valve housing through port 3 to exit port 4 leading to compressor 11 to repeat the cycle in the same flow pattern which represents air-conditioning and air cooling when expanded cold refrigerant at low pressure passes evaporator 27. As indicated, system 12 requires that 5 ports are present in valve 10. For heat pump system pattern, the refrigerant flow has to be completely reversed from that illustrated in the drawing to that described herein wherein the flow from compressor 11 starts with the first port 1 to proceed via port 3 under pressure at adiabatically elevated temperatures entering evaporator 27 by way of conduit 28 for heat extraction first before it is allowed to continue via conduit 26 to enter expander 25 for pressure reduction and return to the compressor 11 via conduit 24 leading to condenser 22 interconnected by conduit 23 with port 2 to exit port 5 leading to compressor 11 to repeat the cycle in the same pattern which represents heat pump and energy conservation, becoming popular during the cold seasons as a supplemental heat source with owners of air-conditioning systems. The 5-th port of valve 10 is to serve as a second fluid return port 5 to compressor 11. To note is the fact that ports 4 and 5 will always feel low system pressure, and therefore neither the first fluid return port 4 nor the second fluid return port 5 needs check valves, a feature that not only saves money when dispensing with normally used check valves but also improves system reliability when using reversing valve 10** with provisions for use without check valves.

Refrigerant supplied under pressure from compressor 11 to valve 10 via port 1 shown discharges into a central large diameter bore portion 13 of an axially extending different diameter bore 14 passing therethrough and closed by two identical coaxially mounted electrical solenoid valve operators 6 and 7 at each opposite housing end inside identical bore portions 29 of a diameter larger than the diameter of central bore portion 13, which is also adaptable to accommodate an optional identical magnetic ring 30 adjacent end of bore portions 29 for stabilization of valving means in one of positions in service. Identical bore portions 31 and **31-*a* of a reduced diameter are shown offset from central bore portion 13 through shoulders 32 and 32-*a* respectively interconnecting the innermost ends of bore portion 13 while shoulders 33 and 33-*a* each at opposite housing end interconnect the reduced diameter offset bore portions 31 and 31-*a* with bore portions 29 respectively. While port 1 enters housing bore 14 perpendicularly through a side wall midway between a first housing end 10-*a* and a second housing end 10-*b*, port 2 enters bore portion 31-*a* through the side wall substantially midway between shoulders 32-*a* and 33-*a* while port 5 enters bore portion 29 of housing end 10-*a* adjacent shoulder 33-*a* whereas the second housing end 10-*b* receives port 3 entering bore portion 31 through the side wall substantially midway between shoulders 32 and 33 while port 4 enters bore portion 29 thereof adjacent shoulder 33**.

Inside said bore 14 we find an elongated stem assembly 8 having a stem 9 provided with a central piston 15 of a diameter slightly less than the diameter of central bore portion 13 to facilitate sliding fit therewith, and two opposing piloted pistons 16 and **16-*a* of an identical diameter which is larger than the diameter of piston 15 but slightly smaller than the diameter of bore portions 29 to facilitate sliding fit therewith, connected to stem ends 17 and 18 respectively over ports of pilot passages inside stem 9 each starting adjacent piston 15 in an overlapping relationship therebetween. The first pilot port 20 feeding piston 16*a* with refrigerant under pressure through stem end 18 initiates adjacent face 15**-*b* of piston 15 facing housing end 10*a* while the second pilot port 19 exposed to low pressure refrigerant flow via port 3 to exit port 4 for return to compressor 11 depicted in the drawing illustrating air-conditioning system prior to fluid reversal to heat pump service initiates adjacent face 15-*a* of piston 15 facing housing end 10-*b* and adaptable to feed piston 16 with refrigerant under pressure only when valve 10 reverses the flow of refrigerant from that shown in the drawing to that described representing reversed heat pump flow.

Both piloted passages of stem 9 supply fluid under pressure to pistons 16 or 16-*a*, having pilot ports 35 and 35-*a* central to each piston face respectively, in an overlapping pattern flowing from the central bore portion 13 alternatingly when desired to feed either pilot piston 16 with high pressure refrigerant while pilot piston 16-*a* is exposed to low side system pressure as is the case with heat pump system described or pilot piston 16-*a* with high pressure refrigerant while pilot piston 16 feels low pressure side of the system through pilot port 19 exposed thereto or vice versa but never both, enabling an operation of this reversing valve by the use of internal pilot means which are novel allowing position change of stem assembly 8 by the use of fluid dynamics coupled with system pressures when one of the solenoid operators is energized electrically to magnetically lift plungers 6-*a* or 7-*a* from piston pilot ports 35 or 35-*a* respectively to pressurize a fluid cavity 34 or 36 formed inside operators 6 and 7 respectively exerting an end force over piston end face of either of the pistons larger than the resisting force over the side faces 15-*a* or 15-*b* of piston 15 at that time prevails inside bore portion 13 urging position change of stem assembly 8 and subsequent reversal of fluid flow through the valve 10 in accordance with former description.

Stem assembly 8 may be shifted from the first air-conditioning system position shown in the drawing to the second heat pump system position described earlier or vice versa by the refrigerant acting as a pilot fluid supplied under pressure from the piston side of the central piston 15 opposite to end face of each piston of stem 9 while the adjacent stem piston is not pressurized. Conversally, stem assembly 8 is shifted from the first position shown in the drawing, depicting air-conditioning flow pattern, by the fluid entering port 20 under pressure to act over end face of piston 16-*a* which is opposite to piston face 15-*b* when solenoid operator 7 is energized electrically and plunger 7-*a* is retracted to allow cavity 36 to built up pressure force that urges instant shifting of stem assembly 8 to the second heat pump flow pattern until piston face 15-*a* becomes effectively pressurized when seal 37 becomes seated firmly against shoulder 33 disconnecting port 4 while port 1 forces refrigerant under pressure to port 3 for flow reversal, simultaneously lifting seal 38 from shoulder 33-*a* to open port 5 for fluid flow from port 2 and cavity 36 via pilot port 20 into a new low pressure side of the system leading to the compressor 11 through the second fluid return port 5 while first return port 4 becomes disconnected from the circuit. The system then becomes reversed heat pump circuit wherein high pressure refrigerant force over piston face 15-*a* maintains stem assembly 8 driftless in the position selected without the need for earlier mentioned magnetic ring 30 since the pressure force over piston face 15-*a* is designed to be of sufficient magnitude for purpose intended, except for the conditions when system is shut-off. For such contingencies, to insure that the stem assembly 8 will always stay in the position it maintained during the operation, it may indeed be desirable to employ magnet 30 for valve position stabilization, although experiments with such valves failed to indicate a definite need for such rings 30. Should such magnetic rings be employed, they can be selected to exert a magnetic force large enough to augment frictional force of two seals 39 pistons 16 and 16-*a* would receive anyway in order to secure fixed positioning of stem assembly 8 inside housing bore 14. The ultimate choice of such magnetic stabilizers will have to made later by the valve manufacturer in conjunction with additional operating data, including consideration of additional friction a seal 40 inside a peripheral groove of piston 15 entails which together with friction seals 39 yield may suffice to speak strongly against the use of stabilizing magnetic ring 30 for to maintain simplicity in valve design and economy in valve manufacturing costs. Referring back to the drawing, it should be noted that the valve housing 10-*d* is an assembly of two identical valve housing parts 10-*a* and 10-*b* doubling as housing ends, joined together by a central housing section 10-*c* so as to leave a circumferential fluid passage gap 21 exactly midway thereof. Consequently, all aspects related to one of the housing ends or parts are automatically repeated without saying in the other housing end, thereby permitting only further reduction of parts manufacturing costs but also simplification of valve assembly wherein stem 9 with central piston 15 can be inserted into the central bore portion 13 first and secured therein permanently through open housing ends by stem seals 37 and 38 adjacent which pistons 16 and 16-*a* with own seals 41 are mounted after housing ends 10-*a* and 10-*b* become assembled by central section 10-*c* into complete valve housing 10-*d* and prior to inserting solenoid operators 6 and 7 which are secured inside housing ends last in final assembly of valve 10.

Subsequently, stem 9 so assembled into stem assembly 8 inside bore 14 serves dual function, namely as a valving means utilizing primarily seals 37, 38 and 40 for flow reversal through valve passages and ports, and also as a valve operating means which allows valve position change when the position of stem assembly 8 is changed wherein pilot pistons 16 and 16-*a* with seals 39, jointly with solenoid operators, connected in operable relationship with solenoid plungers 6-*a* and 7-*a* covering central pilot fluid ports 35 and 35-*a* of piston end faces, to prevent premature pilot fluid escape into solenoid cavities 34 and 36 until one of the solenoid operators is selectively energized electrically to purposely pressurize solenoid cavities chosen, provide best and most simple valve shifting means resulting in flow reversal from that shown in the drawing to that described above or vice versa, and enabling system user to obtain both air conditioning or heat pump heating from the same unit when valve 10 is used.

What is claimed is:

1. A reversing valve for selectively porting refrigerant from compressor to air-conditioning/heat pump system comprising:

a housing means, a first port means in said housing means for receiving compressor fluid under pressure, a second port means in said housing means connected to a system condenser, a third port means in said housing means connected to a system evaporator, a fourth and a fifth port means connected to said compressor for fluid return thereto selectively, a valve means in said housing slidable from a first position allowing pressurized fluid flow through interconnecting conduit means from said compressor to said condenser via said first and second port means for pressure reduction in an expander and for low pressure cold fluid return by way of said evaporator performing air conditioning before entering said compressor via said third and fourth port means, to a second heat pump position reversing fluid flow through said conduit means by forcing fluid from said compressor to flow under pressure to said evaporator for heat extraction first via said first and third port means thereof to continue subsequent fluid expansion and return at low pressure to said compressor by way of said condenser via said second and fifth port means, an operator means for changing said positions of said valve means when desired, an internal pilot piston means in said valve means communicating with compressor fluid under pressure at said first port means in an operable relationship with said operator means and connected to shift said valve means from one of said positions to the other of said positions by means of pilot fluid pressure force over said pilot piston means, and means for exhausting said pilot fluid into said conduit means at low pressure, at the end of each change of said positions, including means for maintaining said valve means in one of said positions substantially driftless.

2. A reversing valve as in claim 1 wherein said housing means include an elongated valve housing assembly having first and second ends interconnected by an axially extending different diameter bore passing therethrough and closed by an identical electric solenoid valves of said operator means at opposite valve housing assembly ends, said valve housing assembly including two opposite spaced identical valve housing parts joined together by a central section thereof so as to leave a circumferential gap between the joined ends of said valve housing parts for fluid flow therebetween, including said first port in said central housing section communicating with said housing bore through said gap and also supplying pilot fluid to said internal pilot piston means via a fluid passages provided therein, while said second, third, fourth and fifth ports enter said housing bore through a side wall, said solenoid valves including magnetically actuated plungers disposed inside said bore ends coaxially with said internal pilot piston means, said plungers being selectively movable between an open position spaced from said internal pilot piston means and defining a fluid cavity therebetween and a closed position in blocking said fluid passages of said internal pilot piston means, wherein when one of said plungers is in said open position said valve means is urged to change position from the one it retained to another by pressurized refrigerant entering said cavity through said fluid passages of said internal pilot piston means and acting against an end face thereof while another of said plungers stays in said closed position or vice versa, said position change including crossing said circumferential gap thereby disconnecting further supply of said pressurized refrigerant to said cavity and allowing fluid exhaust therefrom to said low pressure conduit means at the end of each position change, energization of one of said solenoid valves electrically causing said plunger to be moved from said closed to said open position, deenergization of said solenoid valve that was energized causing said plunger to be forced to and maintained in said closed position by a spring continuously exerting a biasing force on said plunger.

3. A reversing valve as in claim 2 wherein said valve means include an elongated stem assembly having a stem with centrally located piston including piston sides exposed to refrigerant pressure alternatively as dictated by position of said valve means therein and needs for flow reversal from air-conditioning to heat pump service or vice versa, a pair of identical pilot pistons of said pilot piston means secured at each opposite stem end and provided with separate pilot fluid passages extending from each opposite piston side of said central piston toward each pilot piston opposite to said piston side in an overlapping passage relationship for pilot fluid supply to said operator means for changing said positions of said valve means when desired irrespective of location of said central piston inside said housing bore relative to pressurized refrigerant, thereby insuring availability of refrigerant under pressure for said shifting of said valve means from one of said positions to the other of said positions by said means of pilot pressure force over said pilot piston means and ability to remove said pilot pressure force therefrom at the end of said shifting by exhausting said pilot fluid into a low pressure side of said conduit means through the same pilot fluid passage that received refrigerant under pressure at the end of each position change, said pilot pistons of a diameter larger than the diameter of said central piston and capable of developing larger end force when subjected to fluid pressure than the end force said piston sides alternatingly experience.

4. A reversing valve as in claim 3 wherein said means for maintaining said valve means in one of said positions substantially driftless includes a pressure force of refrigerant under pressure over said piston side of said central piston.

5. A reversing valve as in claim 3 wherein said stem assembly, slidably received inside said housing bore doubles as said valve means and said operator means when said stem is secured by seals spaced from said central piston along stem ends adjacent said fourth and fifth port means so as to selectively close said refrigerant return from said fourth port to said compressor while said fifth port is open and to open said refrigerant return from said fourth port to said compressor while said fifth port is closed or vice versa, serving as said valve means thereof in concert with shifting of said stem assembly by said means of pilot pressure force over said pilot pistons which represent an integral part of said stem assembly.

6. A reversing valve as in claim 1 wherein said means for maintaining said valve means in one of said positions substantially driftless includes a magnetic stabilizer means adjacent said pilot piston means inside said housing means.

7. A reversing valve as in claim 3 wherein said piston assembly is provided with seals including peripheral seals in said pistons.

8. A reversing valve in a heat pump-refrigeration system comprising:

an elongated valve housing assembly having a first and a second ends interconnected by an axially extending different diameter bore passing therethrough and closed by an identical coaxial solenoid valve operator at each opposite housing end, said operator including a central plunger movable selectively between an open position when said operator is energized electrically and a closed position when said operator is de-energized, a valving means inside said bore, an elongated stem assembly having a stem with a centrally located piston and pilot ports intiating adjacent thereof in an overlapping relationship therebetween so as to have a first pilot port start on the right side of said centrally located piston and extend generally longitudinally through said stem discharging on the left end thereof while a second pilot port starts on the left side of said centrally located piston extending through said stem longitudinally to discharge on the right end thereof, including large diameter piloted pistons at each stem end with pilot ports closed by said plungers, connected to shift said stem assembly inside said housing bore when one of said plungers is moved to an open position between a first and a second positions of said valving means controlling refrigerant flow pattern through the valve, said stem assembly being positioned therein in accordance with urging of one of said valve operators to have pilot fluid pressure act over one of said piloted pistons when one of said operators is energized electrically during the need to have one of said positions changed, a plurality of refrigerant supply and exhaust ports in said housing assembly entering said housing bore perpendicularly through the side wall including a central circumferential fluid passage gap between two identical, opposing each other housing parts of said valve housing assembly secured by a central section thereof, said gap communicating with said bore, wherein when said stem assembly is in said first position, said valving means having a first fluid supply port interconnected to a compressor entering said bore substantially midway between said first and second housing ends through said central section allows to feed refrigerant under pressure through said gap via a large diameter central bore portion communicating with and adjacent first reduced diameter offset bore portion into a second port spaced a distance away from said first port toward said first housing end for exiting substantially midway from said first reduced diameter offset bore portion into a condenser of a refrigeration system including an expander for pressure and temperature reduction and return via an evaporator to a third port spaced a short distance away from said first port toward said second housing end and reentering said bore substantially midway of an adjacent second reduced diameter offset bore portion leading through a first shoulder to an enlarged first valve actuating bore portion of a diameter larger than said large diameter central bore portion for fluid return back into said compressor via a first fluid return port spaced a short distance away from a first valve operator at the second valve housing end, representing a typical flow pattern common to all conventional air-conditioning systems until said stem assembly is urged by said first operator to shift from said first position to a second heat pump position supplying heat in a completely reversed flow pattern which starts at said first fluid supply port feeding said evaporator via said third port and returning to said compressor expanded at low pressure via said second port leading through a second shoulder to a second enlarged valve actuating bore portion, identical to said first actuating bore portion, provided with a second fluid return port to said compressor spaced a short distance away from a second valve operator at the first valve housing end, said reversed flow pattern through said valve maintained until said stem assembly is urged by said second operator to have said position changed again.

* * * * *